US006062965A

United States Patent [19]

Knowlton

[11] Patent Number: 6,062,965

[45] Date of Patent: May 16, 2000

[54] BACKUP PAD FOR ROTARY GRINDER

[75] Inventor: Glenn R. Knowlton, Sterling, Mass.

[73] Assignee: Norton Company, Worcester, Mass.

[21] Appl. No.: 09/325,201

[22] Filed: Jun. 3, 1999

[51] Int. Cl.[7] ..... B24D 17/00

[52] U.S. Cl. ..... 451/490; 451/527

[58] Field of Search ..... 451/527, 514, 451/515, 516, 490, 509, 508, 449, 548, 463, 539, 359

[56] References Cited

U.S. PATENT DOCUMENTS

| | | | |
|---|---|---|---|
| 2,620,605 | 12/1952 | Holford | 451/509 |
| 3,186,135 | 6/1965 | Crean | 451/548 |
| 3,385,010 | 5/1968 | Vorce et al. | 451/527 |
| 5,123,139 | 6/1992 | Leppert et al. | 451/490 |

FOREIGN PATENT DOCUMENTS

| | | | |
|---|---|---|---|
| 1318689 | 1/1963 | France | 451/526 |

*Primary Examiner*—Robert A. Rose
*Attorney, Agent, or Firm*—David Bennett

[57] ABSTRACT

This invention provides an improved backup pad for an abrasive disk adapted to permit a view of surface as it is being ground which comprises a compressible pad and a relatively rigid support member laminated to the pad that has shorter radial dimensions than the pad in those portions of the circumference of the pad that are likely to snag an angled surface during grinding. The result is that abrasive disks borne on the pad are less likely to tear from such contact.

8 Claims, 2 Drawing Sheets

BACKUP PAD FOR ROTARY GRINDER

The present invention relates to backup pads for rotary grinders and particularly for grinders that permit a view of the surface during grinding.

Rotary grinders comprising a round abrasive disk attached to a backup pad which is mounted on a spindle rotated by the grinder have traditionally been used at an angle of about 30 to 40 degrees to the workpiece being ground such that the edge of the disk is essentially the only part of the disk surface that is used. This is of course wasteful and the intensity of the grinding pressure exerted on a relatively small area means that the disk will be worn out sooner than would otherwise be the case.

This problem was addressed in a pair of cases directed first to a backup pad and second to an abrasive disk to be used with the backup pad, (WO/US96/18927 and WO/US96/19191 respectively). These applications dealt with abrasive disks and matching backup pads in which the objective was to allow the user a view of the surface being ground while the grinder was actually in use. This allows the disk to be used at a much flatter angle such that more of the disk is in contact with the work surface and the pressure is reduced, leading to a longer life. In addition the design of the disk produces interrupted abrading giving time for cooling and swarf removal between grinding intervals. The disks therefore cut cooler and this too contributes to longer life.

Such disks however have one disadvantage in that, operating at a flat angle in a confined space, there is a danger that the edge of the disk grinding a relatively flat surface could come into contact a portion of the workpiece at an angle to the surface being ground and be damaged by such contact. One proposal to minimize this problem is to ensure a small overlap of the disk over the backup pad such that the disk is able to bend to respond to the contact without ripping or losing the integrity of the abrasive surface. This approach is disclosed in U.S. application Ser. No. 09/303,213 filed Apr. 30, 1999 and is highly effective in most cases. In some cases however it is desirable that the abrasive disk be provided with some support even in the peripheral regions. This is the case for example when the disks are paper or film backed such that the disk of its nature does not have the outstanding physical strength of a fiber-backed disk.

The present invention overcomes this problem by providing a backup pad for an abrasive disk with support over the whole surface of the disk but with resilience at the critical edge portions.

DESCRIPTION OF THE INVENTION

The present invention provides a backup pad for an abrasive disk which comprises a circular compressible pad having a first surface adapted for attachment to an abrasive disk and a second surface laminated to a relatively rigid support member having an axially located mounting means for attachment to a rotary grinder, wherein:

a. the compressible pad is provided with from three to six gaps in the circumference spaced around the periphery of the pad and penetrating from 10 to 50% of the radius of the pad; and b. the rigid support member has a similar shape and dimensions to the compressible pad except that a segment is removed from at least a portion of the circumference of the support member between the gaps such that the pad extends radially beyond the support member in the vicinity of such removed segments.

While the whole of the backup pad has resilience against pressure normal to the pad, the edge portions which support the portion of an abrasive disk most susceptible to damage, that is the radial extremities, are able to deform to a greater extent where the compressible pad is not backed by the relatively rigid support member.

The extent of the overlap of the compressible pad beyond the support member is generally not greater than about 15%, such as for example from 2 to 10%, of the greatest radial dimension of the compressible pad. This overlap can be by a uniform amount but more frequently the segment of the circumference removed is a chord segment such that the degree of overlap is greatest at the center of the segment and diminishes towards at least one of the ends.

The gaps in the circumference of the compressible pad and the support member are similar in shape and extent. They can have any desired dimension and can extend towards the center, or axis, of the backup pad to a point that is as much as 50%, for example from 20 to 45%, of the maximum radius of the backup pad.

The points at which the gaps meet the circumference of the backup pad are preferably rounded to minimize the danger of the edges catching during rotation. Since an abrasive disk and its associated backup pad usually have a design direction of rotation, one edge of the gap can be designated the "leading edge" and the other the "trailing edge". In such cases it is necessary only to round off the trailing edge of the gap. Such "rounding off" is preferably more pronounced on the support member than on the compressible pad. As a result there is an overlap of the compressible pad over the support member in the rounded-off area which becomes continuous with the overlap as a result of the removal of a segment from the periphery of the support member.

The shape of the gap can be angular, such as a V-shape, or more preferably curved as for example would be the case if the shape was that of a notional circle with a portion lying beyond the radius of the backup pad. More preferably however the shape of the gap is generally parabolic with the arms of the parabola diverging towards the edge of the backup pad. In a particularly preferred form of gap the shape is parabolic with the axis of the parabola non-coincident with a radius of the backup pad. In this preferred form, the leading edge of the gap is shorter than the trailing edge and, in a preferred symmetrical form of this configuration, the axes of all the parabolic gaps in the backup pad form a geometric shape with the axis of the disk at the geometric center of the shape.

The material from which the compressible pad is made is usually a foamed rubber such as a polyurethane, but any resilient material can be substituted depending on the degree of resilience demanded by the application. The thickness of the pad is typically from about 3 to about 15 mm and preferably from 5 to 10 mm. The maximum radial dimension is largely determined by the abrasive disk it is intended to support and thus backup pads with maximum radial dimensions of from about 7.6 to 17.7 cm are generally preferred.

One surface of the compressible pad is provided with a means for attachment of an abrasive disk. This means could include for example a surface adapted to receive an abrasive disk with a pressure sensitive adhesive backing, an adhesive coating adapted to adhere to the back of an abrasive disk, or one half of a "hook and loop" attachment mechanism. This latter term is intended to cover all mechanisms in which a releasable physical attachment of two components occurs such that rotational movement of one component results in a similar movement of the other component. It therefore includes entanglement means such as "hooks", (which is intended to include all configurations in which a protruding member interacts with a fabric in an entanglement mode), with cooperating fabrics having loopy surfaces such as velours, and interlocking molded shapes.

The support member is conveniently made from a relatively rigid plastic such as a polypropylene, nylon, acrylonitrile-butadiene-styrene copolymer (ABS), high-impact polystyrene, similar dimensionally stable polymers and rubbers that are relatively rigid such as at least partially vulcanized rubbers. It can also be made from a metal or a ceramic if desired though this tends to be more expensive.

The support member is provided with means adapted to permit the backup pad to be mounted on a rotary drill or grinder. This means can comprise a spindle which is either integral with the support member or attachable thereto by a suitable mechanism, The means can also comprise a socket for a drive spindle such as a socket with snap-fit mechanism or other quick release catch, a threaded socket or member, or similar device.

DRAWINGS

FIG. 1 is a plan view of a backup pad according to the invention shown from a first side and FIG. 2 is a plan view of the same backup pad from the opposed side.

DESCRIPTION OF PREFERRED EMBODIMENTS

Figure 1:
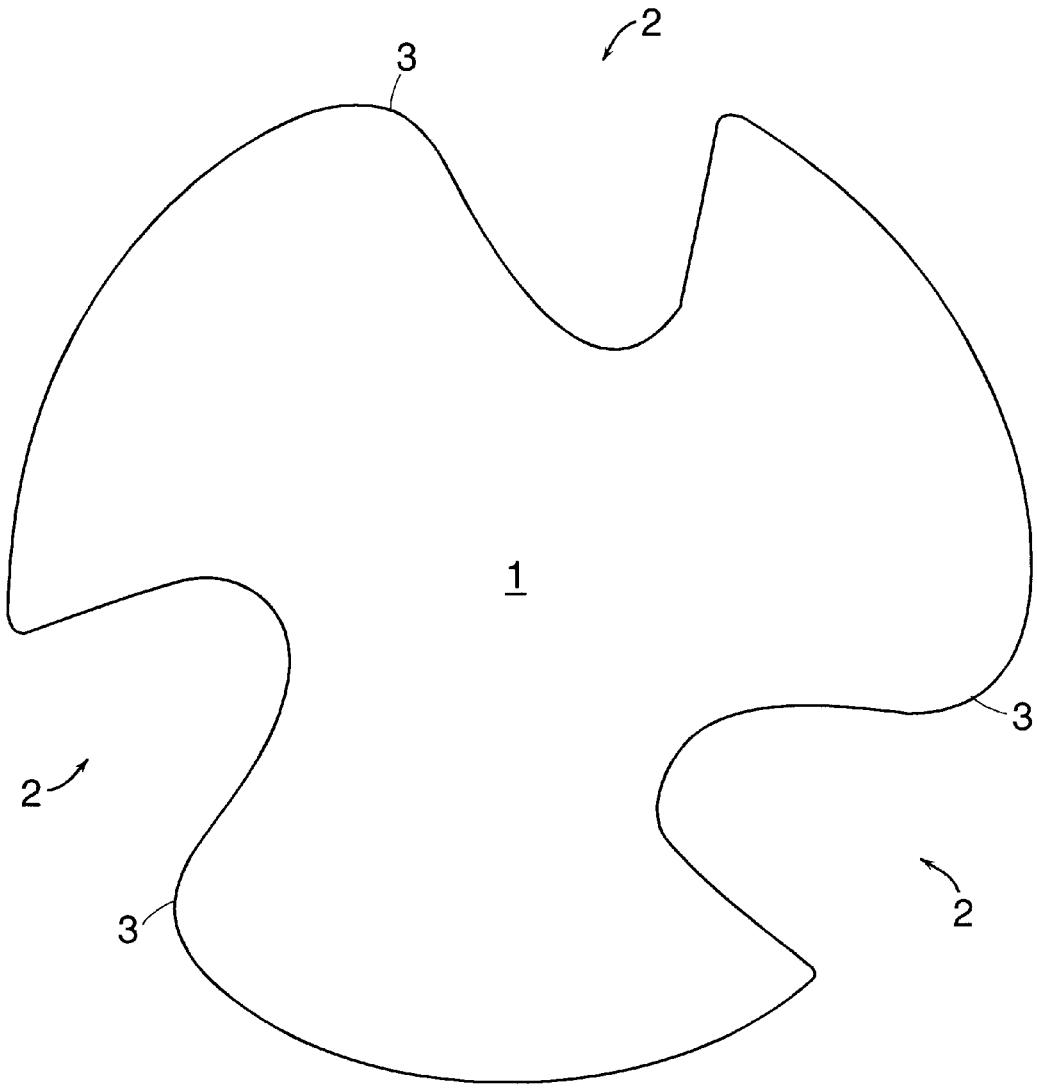

The backup pad according to the invention is now described with particular reference to the Drawings which depict a preferred form of backup pad from both sides. In FIG. 1 only the generally disk-shaped compressible pad, 1, is visible. This comprises three equal and symmetrically located gaps, 2, in the circumference of the pad. The design direction of rotation is clockwise, the trailing edge, 3, of each gap is rounded. The shape of the gap is otherwise generally parabolic, with the axis of the parabola at an angle to the radius of the pad such that the leading edge of the parabola is shorter than the trailing edge. In this particular embodiment, the surface shown is provided with the hook component of a hook and loop attachment means. However any other suitable attachment can of course be used.

Figure 2:
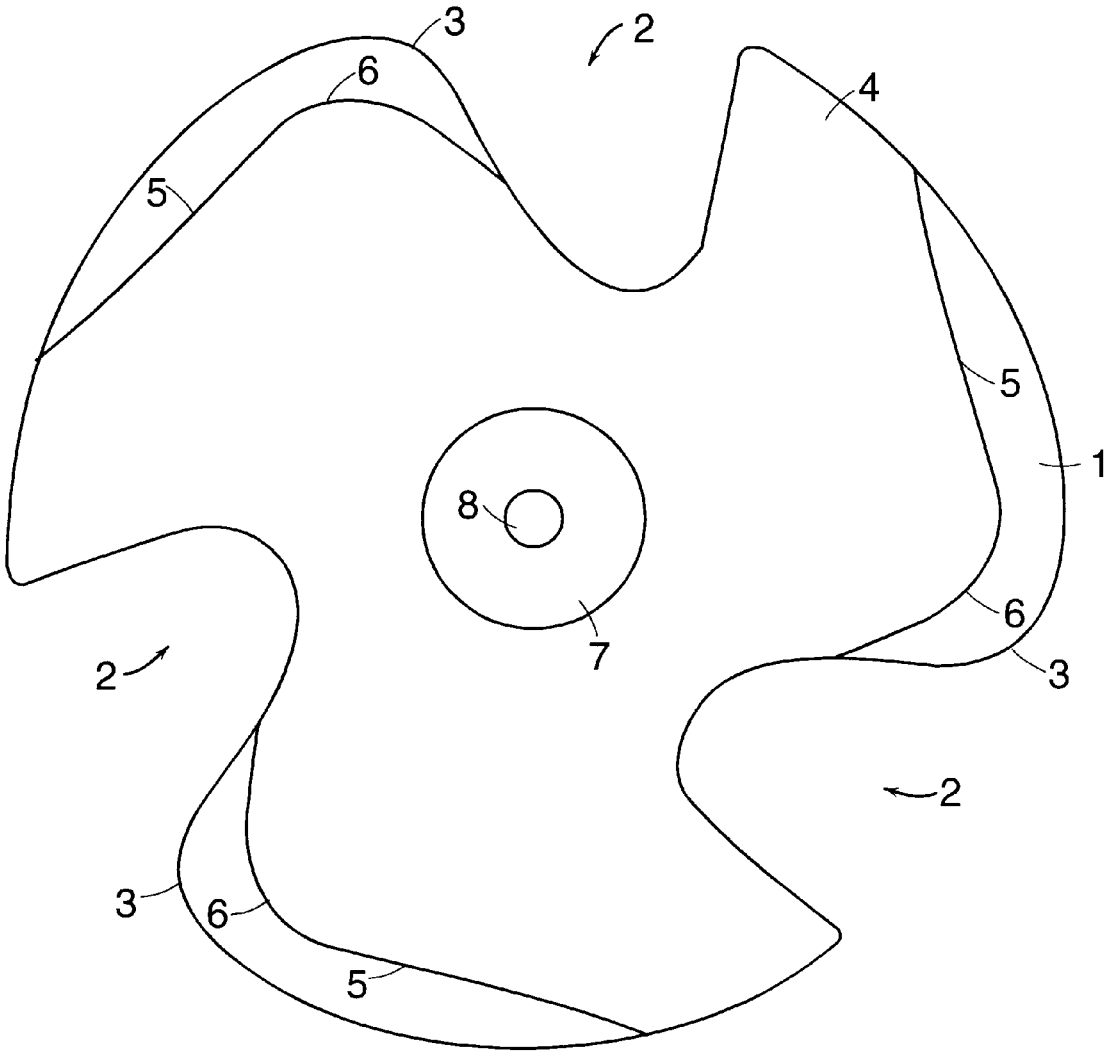

FIG. 2 shows the other side of the backup pad and includes the support member, 4, laminated to the compressible pad, 3. In addition to the same parabolic gaps in the circumference displayed by the compressible pad, the support member has chord segments, 5, removed from the circumference and the trailing edge, 6, of each gap is rounded even more pronouncedly that that of the compressible pad. An axially located boss, 7, is used to mount a spindle, 8, by which the backup pad can be mounted on a rotary drill or grinder.

In use an abrasive disk with essentially the same dimensions as the compressible pad is mounted on the attachment surface of the compressible pad. Rotation of the abrasive disk allows vision of the surface being abraded through the circumferential gaps. In the event that the disk contacts a surface at an angle to the surface being ground, the contact will occur initially and with greatest force, at the radial extremities of the disk. Because at that point the disk is backed by a compressible pad but not by the relatively rigid support member, the disk and the compressible pad are able to deform to absorb the impact and thus avoid any tearing of the abrasive disk.

What is claimed is:

1. A backup pad for an abrasive disk which comprises a circular compressible pad having a first surface adapted for attachment to an abrasive disk and a second surface laminated to a relatively rigid support member with an axially mounted means for attachment to a rotary grinder, wherein:

a) the circular compressible pad is provided with from three to six gaps in its circumference spaced around the circumference of the pad and penetrating from 10 to 50% of the radius of the pad; and b) the relatively rigid support member has a similar shape and dimensions to the compressible pad except that a segment is removed from at least a portion of the circumference of the support member between the gaps such that the pad extends radially beyond the support member in the vicinity of such removed segments.

2. A backup pad according to claim 1 in which the segments removed from the circumference of the support member are chord segments.

3. A backup pad according to claim 1 in which the pad has a preferred direction of rotation giving each gap a leading edge and a trailing edge, wherein the trailing edge is rounded as it meets the circumference.

4. A backup pad according to claim 3 in which the gaps in the circumference have a generally parabolic shape and the axis of each parabola does not coincide with a radius such that the trailing edge is longer than the leading edge.

5. A backup pad according to claim 1 in which the first face of the compressible pad bears one half of a hook and loop attachment system.

6. A backup pad according to claim 1 in which the overlap of the compressible pad over the support member is up to 10% of the radius of the pad.

7. A backup pad according to claim 1 in which the compressible pad and the support member are provided with aligned apertures in the spaces between the gaps in the circumference.

8. A backup pad according to claim 1 in which the compressible pad is made from a foamed polyurethane.

* * * * *